United States Patent [19]

Kowalski

[11] Patent Number: 4,481,717

[45] Date of Patent: Nov. 13, 1984

[54] ARCHERY BOW SIGHT

[76] Inventor: Robert J. Kowalski, 512 Berner St., Pittsburgh, Pa. 15215

[21] Appl. No.: 461,646

[22] Filed: Jan. 27, 1983

[51] Int. Cl.[3] ..... F41G 1/00

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,579,839 | 5/1971 | Kowalski | 33/265 |
| 4,020,560 | 5/1977 | Heck | 33/265 |
| 4,195,414 | 4/1980 | Robinson | 33/265 |
| 4,305,208 | 12/1981 | Larson | 33/265 |

*Primary Examiner*—Willis Little

*Attorney, Agent, or Firm*—Clifford A. Poff; Thomas H. Murray

[57] ABSTRACT

There is disclosed a bow sight including an elongated frame with a mounting plate for securing the frame to a bow above the arrow-receiving portion thereof. Upper and lower flanges on the frame support opposite ends of a threaded shaft which, at the top of the frame, is coupled with a pulley engaged with a belt coupled to a pulley on the shaft of a motor that is also mounted on the frame. The motor is reversible and depending on its direction of rotation, the threaded shaft is rotated to raise or lower a sighting assembly that is threadedly engaged with the shaft. The sighting assembly includes a lens with colored range markings thereof. The markings have a center that is horizontally spaced from an illuminated stylus. The colors of the range markers correspond to the colors of markers horizontally spaced along the frame of the sight. The sighting assembly is moved vertically so that a pointer is aligned with a selected color marker corresponding to the color of the field marking on the lens.

19 Claims, 7 Drawing Figures

ARCHERY BOW SIGHT

BACKGROUND OF THE INVENTION

This invention relates to an archery bow sight having a stylus horizontally spaced from a field range lens to establish the range of a target whereupon the stylus and lens are moved vertically along the sight into one of a plurality of preestablished positions corresponding to a determination of the range of a target. More particularly, the present invention relates to such an archery bow sight that preferably includes drive means in the form of an electric motor for moving the sighting elements through the operation of a switch on the bow and means for illuminating the stylus of the sighting elements.

An experienced archer will always nock an arrow at the same point on a bow string, draw the string back so that a particular portion of the hand contacts a particular portion of the head, elevate or lower the head of the arrow to compensate for the distance the arrow is expected to fall during flight before hitting the target, and then release the string to propel the arrow toward the target. This procedure is executed so that the feathered end of the arrow is always substantially at the same distance from the eye such that the only variable condition for hitting the target is the distance between the target and the arrow. Some archers aim a bow by intuition; while skilled archers employ bow sights. Bow sights are used for sighting or aiming the arrow at different ranges. A bow sight may be provided with a single sighting element that can be slid along a track extending substantially parallel to the string of the bow. The track for the sighting element will extend above the arrow-receiving portion of the bow such that the sighting element is elevated or lowered to a position corresponding to the range or distance over which the arrow is to be shot. The track member may have positions indicated thereon to correspond to different ranges through which the arrow is to be shot. An example of this type of a sight can be found in U.S. Pat. No. 2,998,652. This type of bow sight is not satisfactory for a hunter. A hunter, upon sighting a target which may, for example, be a deer, must estimate the distance of the target, adjust the sight, nock his arrow, aim and then release the arrow. The hunter's actions must be completed quickly to avoid loss of sight of the target. However, a considerable amount of time is required to loosen the sighting element, locate it in a new position corresponding to the estimated distance to the target and then retightening the sighting element.

Another common type of sighting element employs a plurality of sighting elements, each of which is spaced above the arrow-receiving position of the bow by a different distance. An archer must estimate a particular range or distance between the target and the bow and then select a particular sighting element corresponding to the selected range and release the arrow using the selected sighting element. The highest sighting element corresponds to a short range while the lowest sighting element corresponds to the longest range. The sighting elements are prepositioned by experimentation with the bow on which the sight is mounted. One example of this type of bow can be found in U.S. Pat. No. 2,332,080. This type of sight is unsatisfactory because during aiming of the bow, it is extremely confusing to the archer to have a plurality of sighting elements in the field-of-view. In my prior U.S. Pat. No. 3,310,875, there is disclosed an archery bow sight having a plurality of sighting elements disposed above an arrow-receiving portion of the bow and spaced therefrom at different distances. The sighting elements are normally disposed in an out-position wherein they are out of the line of sight. Each of the sighting elements is movable between the out-position and a sight-position wherein they extend transversely to the body of the bow and can be selected for aiming the bow. The sighting elements are prepositioned on a carrier member by experimentation. A sighting element is secured at a known position along the carrier member and used for sighting a target which is at a predetermined distance from the bow. However, the sight member is repositioned in the event the arrow strikes the ground ahead of the target or beyond the target. The markings on the sighting element are selected to indicate to the archer the distance between the target and the arrow before the archer releases the arrow.

Another example of this type of archery bow sight is disclosed in my U.S. Pat. No. 3,579,839 in which an archery bow sight incorporates a Vernier adjustment on the bracket for modifying the range after the sighting element is positioned at an approximate range position along the bracket. A screw device is supported between flanged portions of an elongated member adapted to be secured to the body of a bow. A plurality of sighting element carriers is threadedly received on the screw device and means are provided for preventing rotation of the carrier as the screw device is rotated such that the carrier can be moved upwardly or downwardly as the screw device is rotated. This construction of parts is intended to provide a Vernier adjustment of the sighting elements mounted on the carrier by rotation of the screw means.

Another form of an archery bow sight of this type is disclosed in my U.S. Pat. No. 3,822,479 in which a bow sight incorporates adjusting means for each of a plurality of sighting elements by which each element can be moved along a screw device independently of other sighting elements. A master dial is used for rotating the screw device to move all sighting elements in unison and resilient means releasably holds each sighting element in a sighting or out-position.

The present invention provides improvements over known forms of bow sights to greatly enhance the operation of the bow sight as well as the archer's use thereof. The present invention is particularly intended to facilitate establishing and adjusting a sight according to the range between an arrow and the target.

SUMMARY OF THE INVENTION

It is an object of the present invention to provide an archery bow sight to establish the range between an archer and the target and to adjust bow sighting elements without disruption to the normally-set position of the archer in which he has drawn an arrow for launching.

It is a further object of the present invention to provide an archery bow sight in which a transparent lens is provided with a plurality of field range markings to determine a target distance which is then used for moving a stylus that is preferably illuminated, together with the lens to a preestablished elevation along the bow, preferably by the use of a battery-powered motor.

More particularly, according to the present invention, a sight is provided for aiming a bow, the sight comprising, in combination, an elongated frame adapted to be secured to a bow above the arrow-receiving portion thereof, the frame having upper and lower flange portions, a threaded shaft arranged vertically for rotatable support by the flange portions of the frame, sighting means supported on the shaft, the sighting means including a stylus horizontally spaced from a transparent lens having a plurality of field range markings to establish a target distance by selecting one of said markings in a line of sight with the stylus and the target, a carrier supported by the frame to extend generally parallel to the shaft, a plurality of range markers adapted for support by the carrier at predetermined spaced-apart locations between the flanges of the frame, marker means supported by the sighting means for alignment with any one of the range markers, and drive means coupled to the shaft for displacing the sighting means to align the marker means with a preselected one of the range markers.

The drive means preferably includes a motor supported by the frame and having a pinion wheel coupled by a belt to a drive wheel which is mounted on one end of the aforementioned threaded shaft for moving the sighting means vertically along the frame. It is especially advantageous to provide switch means on the bow in close proximity to a hand-grip area of the bow for operation by the archer to energize the motor and move the sighting means in a desired direction and to a preselected position along the frame. The stylus of the sighting means is preferably illuminated by an electric light bulb or the like to speedily establish the line-of-sight relation between the lens, stylus and target for not only determining the range between the sight and the target but also enabling the archer to accurately establish a sighted position for the bow when launching an arrow.

The sighting means preferably includes a support block threadedly engaged with the threaded shaft to move therealong between flange portions of the frame, a sight base to support the stylus and the lens, arm means carried by the support block to carry the sight base outwardly at a side of the bow generally above the arrow-receiving portion thereof. The arm means is preferably comprised of a windage-adjustment shaft and a knurled knob engaged with the shaft for moving the sight base toward and away from the support block. The lens comprises a plate made of glass-like material, e.g., clear plastic, and has circular markings of different diameters and colors printed thereon to form range markings. The lens extends generally parallel to the threaded shaft which is also generally parallel to the bow string in its relaxed or untensioned position. A switch for the electric light bulb to illuminate the stylus is also situated on the bow at a grip area thereof for the archer so that the switch can be actuated when pressure is applied by the archer's hand to the bow during drawing of the string. In this way, the stylus will be illuminated when the archer draws the bow. The range markers each preferably including a marker element and a threaded fastener for attaching the marker element to the aforementioned carrier. The carrier preferably takes the form of an elongated strip having a central slot therein to receive the fastener for the marker and affix the marker on the plate.

These features and advantages of the present invention as well as others will be more fully understood when the following description of the preferred embodiment of the present invention is read in light of the accompanying drawings, in which.

Figure 1:
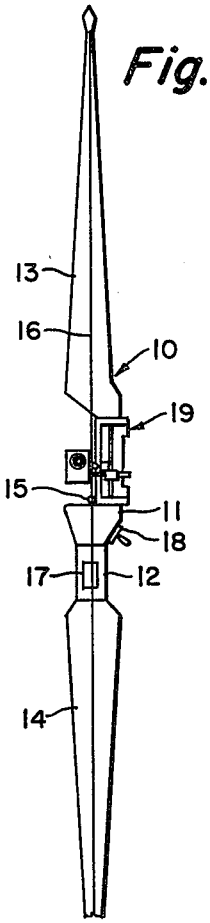
FIG. 1 is an elevational view of a bow provided with a bow sight of the present invention.

A conventional bow 10 is illustrated in FIG. 1. The bow includes a central body portion 11, a gripping portion 12 beneath the central body portion and a pair of upper and lower arms 13 and 14, respectively, that extends upwardly and downwardly from the central body portion 11 of the bow as seen by an archer using the bow. Above the central body portion 11 there is a receiving area 15 for an arrow that is engaged with a string 16. When the string is pulled away from the central body portion, the arms 13 and 14 bend to provide a force for propelling the arrow. According to the present invention, it is preferable to provide the gripping portion 12 with a switch 17 that is actuated by the pressure which is applied by the hand of the archer to the gripping portion when drawing the bow. A second switch, identified by reference numeral 18, is also supported on the bow at any convenient sight, preferably in close proximity to the gripping portion 12 so that the switch can be actuated by the finger of an archer. Switch 18 is preferably a toggle of the double-pole, double-throw type, with a center OFF position for reversing the polarity of current supply to a direct current electric motor. Secured to the side of the central body portion 11 by means of a bracket is a bow sight 19 of the present invention.

Figure 2:
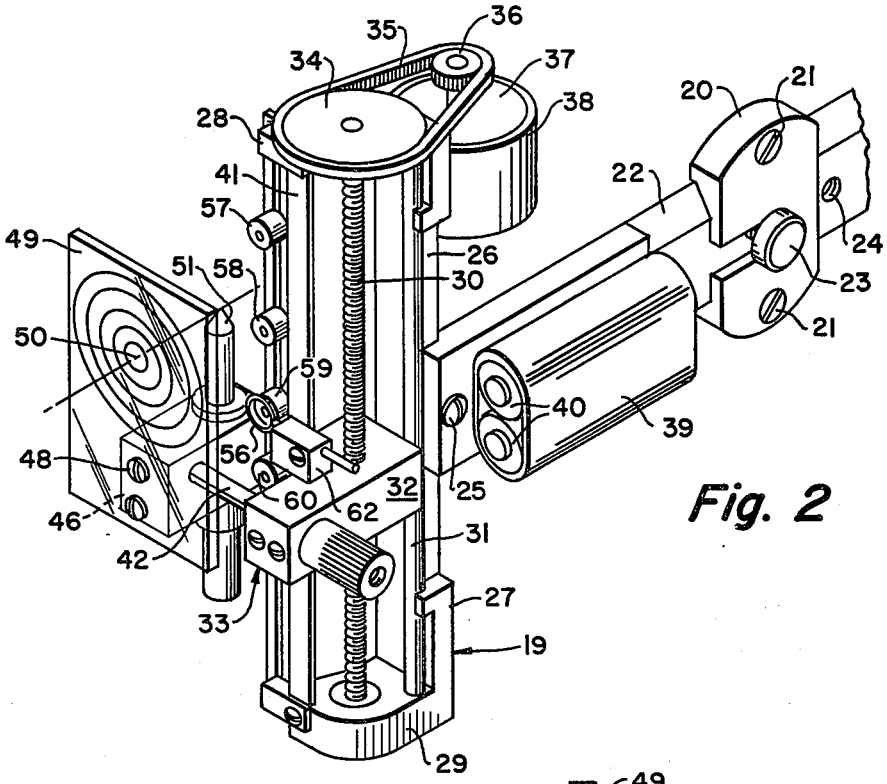
FIG. 2 is an isometric view of the bow sight of the present invention.

As shown in FIG. 2, the sight 19 is attached to the bow by the use of threaded fasteners 21 which are passed through openings in an anchor plate 20 into the bow. An arm 22 extends from the bow sight 19 into the anchor plate 20. A bolt 23 or other form of fastener is introduced into a selected one of spaced-apart threaded openings 24 in the plate to provide for adjusting the plate and the bow sight inwardly or outwardly for a particular bow string position. The arm 22 is detachably secured by a fastener 25 which is introduced into a selected one of spaced-apart openings 26 provided in the side wall of an elongated frame 27 forming part of the bow sight 19. In this manner, the entire bow sight can be adjusted upwardly or downwardly to suit the requirements of a particular bow and archer. The frame 27 is provided with upper and lower flanges 28 and 29, respectively, to rotatably support the opposite ends of a shaft 30 having a threaded central portion between the flanges. A post 31 also extends between the flanges to strengthen them and to serve as a guide for sliding movement of a support block 32 forming part of a sighting assembly 33. The shaft 30 and post 31 are each retained in position by fasteners such as snap rings engaged with each of the opposite ends thereof. The shaft 30 has an end portion projecting from the top flange 28 where it is secured to a drive pulley 34. A belt 35 drivingly interconnects the drive pulley 34 with a pinion 36 mounted on the drive output shaft of an electric motor 37. A casing 38 is attached by suitable fasteners, not shown, to the frame 27 for receiving and supporting the motor 37. Another casing 39 is attached by fasteners or the like to arm 22 for supporting one or more batteries 40 forming an electrical power supply for the motor 37 as well as an electric light bulb to illuminate a stylus as described below.

Figure 3:
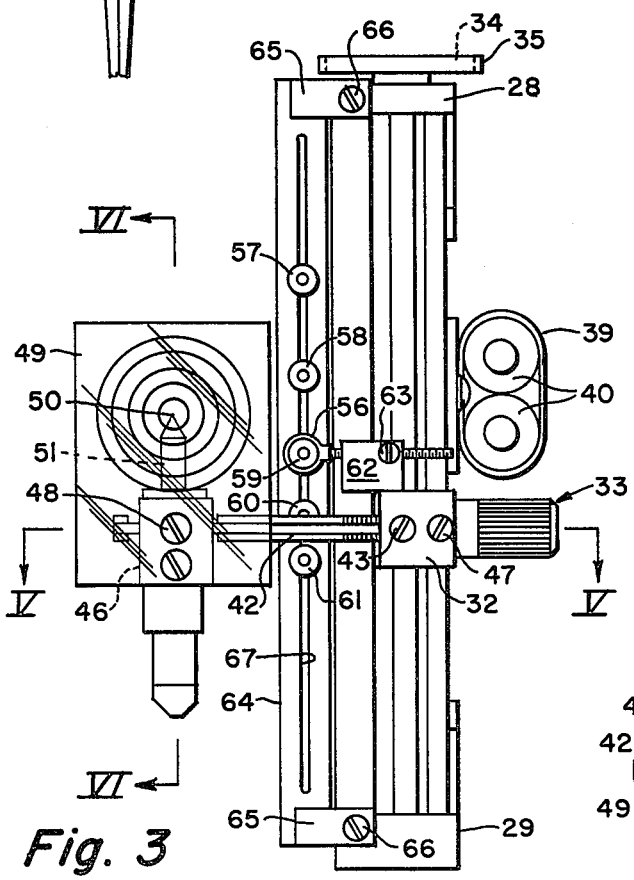
FIG. 3 is a front elevational view of the bow sight shown in FIG. 2.
Figure 5:
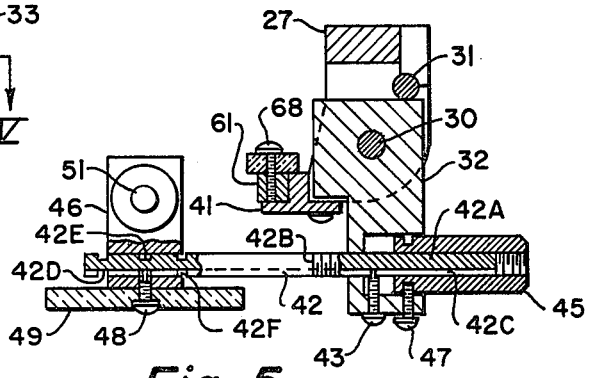
FIG. 5 is a sectional view taken along line V—V of FIG. 3.

As shown in FIGS. 3 and 5, the support block 32 of sighting assembly 33 is guided by the post 31 and by a guide bar 41 that also extends between the upper and lower flanges 28 and 29. The rod 31 and guide bar 41 are situated so as to prevent rotation of the support block 32 about shaft 30 while at the same time permitting free and unimpeded sliding movement of the support block along the height of the frame between the flanges thereof.

As shown in FIGS. 2, 3 and 5, the support block 32 has a drilled opening to support a windage-adjustment rod 42. Rod 42 has an externally-threaded end portion 42A terminating at 42B from where the external surface extending to the left, as one views FIG. 5, is smooth and cylindrical. A key slot 42C extends the length of rod 42. The left-hand end portion of rod 42, as one views FIG. 5, has one or more, preferably three, spaced-apart circumferential grooves 42D, 42E and 42F. Typically, these grooves are spaced about ¼ inch on centers. The rod 42 is supported for only sliding movement in the opening of the support block 32. A screw 43 is threaded in the support block to extend into the key slot 42C of the rod 42. The windage-adjustment rod can be moved in the direction of its length by rotating a knob 45 that has a central opening with threads for mating engagement with the threaded end portion 42A of the windage-adjustment rod. The knob 45 is received in a counterbore in the suppor block where it is locked against longitudinal movement by a stop screw 47 that is passed through an opening in the stop block into a peripheral groove on the end of the knob which is received in the stop block. The end of the windage-adjustment rod which is remote to the knob 45 is received in a drilled opening of a sight support block 46 and attached thereto by one of two threaded fasteners 48. These fasteners 48 are passed through drilled openings in the lower central part of a range sight lens 49, preferably comprised of a circular plate of glass-like material such as crystal polystyrene. However, a rectangular lens can be used without departing from the present invention. The fasteners extend through the lens so that the head portions engage the lens while threaded shank portions are received in threaded openings in the sight block. A tip portion of one fastener 48 extends in the key slot 42A of rod 42 to prevent movement of the sight block on the shaft. The present invention provides a coarse windage adjustment in addition to a micrometer-type windage adjustment provided by rotating knob 45. The coarse windage adjustment is achieved by sliding the block 46 along rod 42 to a preselected location where the extended tip portion of fastener 48 is received in one of the grooves 42D, 42E and 42F. This construction also permits 360° rotation of the block 46 and the lens supported thereby about rod 42 and thereby accommodates any preferential or desired angular positioning of the lens. The lens is supported such that a parallel relation normally exists with the length of the shaft 30 and a face surface of the lens. The front or, if desired, rear, face surface of the lens includes a series of sight markings that are printed, painted or defined by separate pieces attached to the lens.

Figure 6:
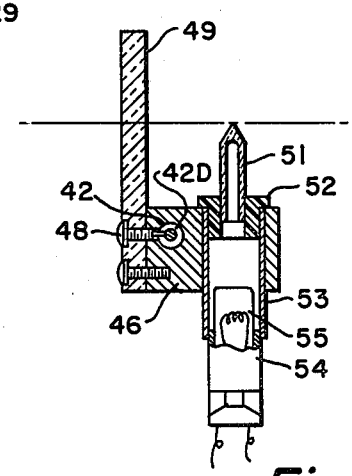
FIG. 6 is a sectional view taken along line VI—VI of FIG. 3.
Figure 4:
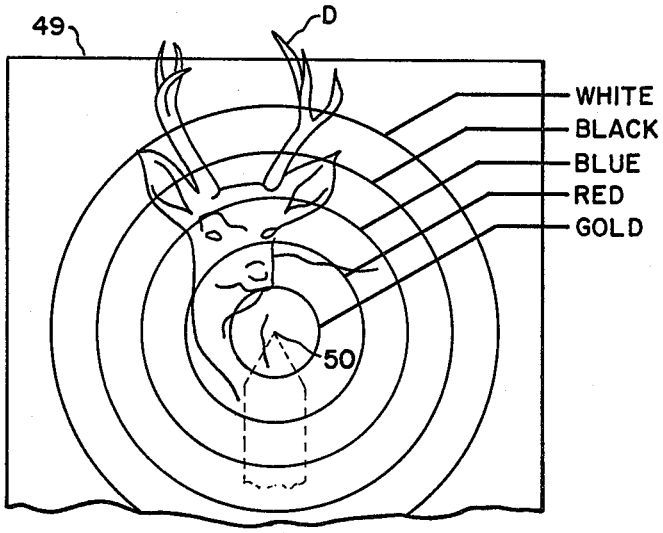
FIG. 4 is an enlarged view of a lens element and stylus according to the present invention.

As shown in FIG. 4, in its preferred form, the field range markings are identified by color legends WHITE, BLACK, BLUE, RED and GOLD. The markings in the form of concentric circles have a common center with the color markings corresponding to a color-coded system that is standard for archery targets. The field range markings are located about a center 50 which is horizontally spaced, in the direction toward the target, from a pointed end of a stylus 51. As shown in FIG. 6, the stylus is preferably comprised of light-conductive material such as plastic and received in a bushing 52 that is, in turn, mounted in a sleeve 53 that is received in a drilled opening in the block 47. The sleeve projects from the bottom of the block 47 and receives a socket 54 in which there is mounted an electric light bulb 55. When the bulb is energized, the light energy propagates along the stylus for enhanced visibility of the tip portion thereof.

Turning, again, to FIG. 4, an archer will aim the sight of the present invention by drawing the bow and determining the color of the field range marking which most nearly surrounds and includes a target area. In FIG. 4, the target D is depicted as a deer. When drawing the bow, the archer will actuate the pressure-sensitive switch 17 (FIG. 1) which will energize the light bulb 55 in a substantially automatic manner and eliminate the requirement for the archer to intentionally actuate a switch to turn ON the bulb. After the archer selects the color of the field range marking which most closely includes the target, switch 18 is actuated to turn ON motor 37 for rotation in a direction which is determined by the direction in which the switch is thrown. Operation of the motor rotates shaft 30 which, depending upon its direction of rotation, raises or lowers the sight assembly to a position in which a pointer 56 is aligned or otherwise centered on one of a plurality of markers 57, 58, 59, 60 and 61. These markers are each preferably a different color and the colors are arranged to correspond to the colors of the field range markings on the lens 49. The color of the marker 61 is GOLD and the pointer will be directed to this marker when the target is at a maximum range for which the sight has been adjusted to accommodate. Similarly, when pointer 56 is centered on marker 57 which is WHITE, the target is at the closest range. Between these markers, marker 58 is BLACK, marker 59 is BLUE and marker 60 is RED. The pointer 56 is carried by a threaded shank that is received in a tapped hole formed in a marker block 62. A set screw 63 is threaded into a tapped hole in the marker block to lock the threaded shank of the marker at a desired position. The marker block can be releasably attached to the block 32 or, if desired, provided with a support leg that has a drilled opening for receiving part of the rod 42 and secured thereto by a set screw.

The markers 57–61 are each preferably comprised of a rod of plastic material having a face surface that fits against a carrier plate 64. The carrier plate is secured at its opposite ends to the upper and lower flanges 28 and 29, respectively, by brackets 65 and threaded fasteners 66. The plate 64 has a centrally-disposed elongated slot 67 through which a threaded shank portion of a screw 68 can pass so that the threads thereof can be advanced through a pilot hole into the plastic material of a marker. The threaded fastener thereby provides a means for clamping a marker at a desired elevation along the carrier plate 64. By rotating the fastener in the direction to withdraw it from a marker, the marker is unclamped and can be freely moved along the slot to a desired position corresponding to the range which has been determined by the archer during a "sighting-in process".

The construction of parts for the sight of the present invention enables an archer, participating in archery competition, to compensate for the effect of crosswinds by lateral positioning of the block 47 relative to the frame 27. This is accomplished by rotating the knob 45 to move the rod 42 in the direction of its longitudinal length to thereby cause the lens and stylus to be moved together toward or away from the side of the bow.

Figure 7:
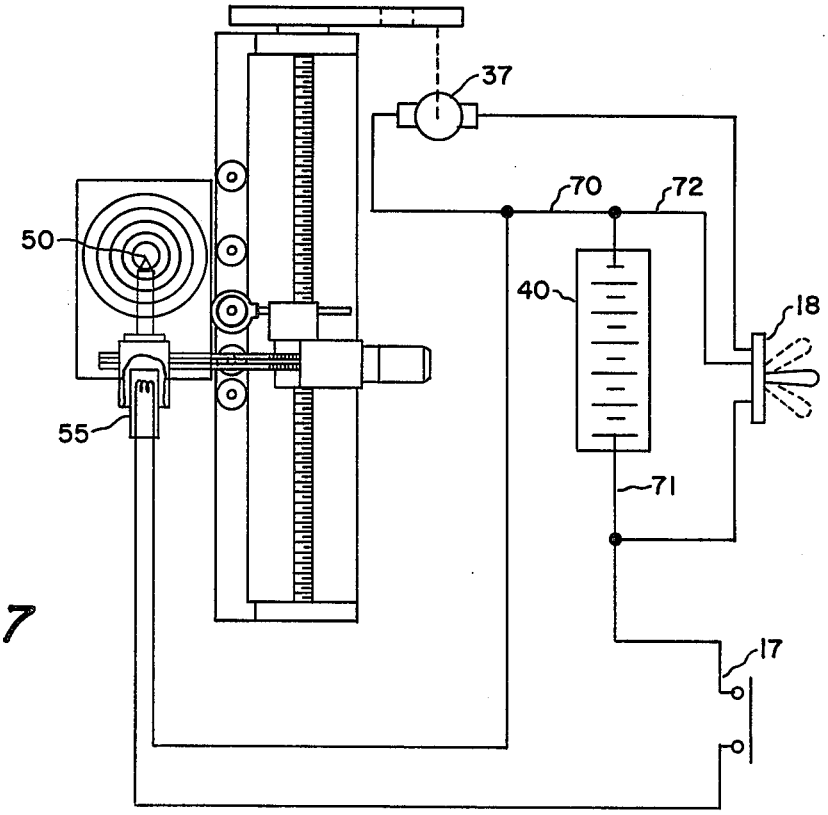
FIG. 7 is a schematic view of an electric circuit for the archery sight shown in FIG. 2.

FIG. 7 illustrates schematically the electrical circuitry for the sight of the present invention. As shown, one side of the battery 40 is coupled by a lead wire 70 to one lead wire for each of the motor 37 and bulb 55. A wire 71 is connected by leads to the two-position toggle switch 18 and pressure-sensitive switch 17. Current is applied to bulb 55 when pressure-sensitive switch 17 is in its closed position to thereby complete a circuit including the battery. Toggle switch 18 is also connected by a lead wire 72 joined with wire 70 such that the current flow from the battery to motor 37 can be selectively reversed by operation of the two-position toggle switch.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A sight for aiming a bow comprising, in combination:

an elongated frame adapted to be secured to the bow above the arrow-receiving portion thereof, said frame having upper and lower flange portions, a threaded shaft arranged vertically for rotatable support by said flange portions, a sighting means threadedly supported on said shaft, said sighting means including a stylus horizontally spaced from a transparent lens having a plurality of field range markings to establish a target distance by selecting one of said markings in a line-of-sight with said stylus and a target, a carrier supported by said frame to extend generally parallel to said shaft, a plurality of range markers adapted for support by said carrier at predetermined spaced-apart locations between said flanges, marker means supported by said sighting means for alignment with any one of said range markers, and drive means coupled to said shaft for displacing said sighting means to align said marker means with a preselected one of said range markers.

2. The sight according to claim 1 wherein said drive means includes a motor supported by said frame, a pinion wheel driven by said motor, a drive wheel engaged with said threaded shaft, and belt means for drivingly interconnecting said pinion wheel and said drive wheel.

3. The sight according to claim 2 further including switch means supported by said bow for controlling said motor.

4. The sight according to claim 3 further including means supported by said sighting means for illuminating said stylus.

5. The sight according to claim 4 further including switch means supported by said bow for controlling said means for illuminating.

6. The sight according to claim 4 wherein said stylus is comprised of light-transmitting material.

7. The sight according to claim 1 wherein said sighting means includes a support block supported by said threaded shaft to move therealong between the flange portions of said frame, a sight base to support said stylus and said lens, rod means carried by said support block to support said sight base outwardly at the side of said bow above the arrow-receiving portion thereof.

8. The sight according to claim 7 wherein said rod means includes a windage-adjustment shaft, and means engaged with said rod for moving said sight base toward and away from said support block.

9. The sight according to claim 7 wherein said lens is comprised of a plate made of glass-like material and having circular markings thereon of different diameters and colors defining said field range markings, and means to hold said plate on said sight base to extend generally parallel to said threaded shaft.

10. The sight according to claim 7 wherein said sight base has an opening generally parallel to said threaded shaft, said sight further including means for mounting said stylus in said opening to extend vertically from one side thereof, said stylus comprising light-transmitting material, illuminating means for said stylus, and means for mounting said illuminating means in said opening at the side thereof opposite said stylus.

11. The sight according to claim 1 further including windage-adjustment means for adjustably positioning said sighting means relative to said frame.

12. The sight according to claim 1 wherein said carrier is supported by the flange portions of said frame to extend generally parallel with said threaded shaft, and wherein said plurality of range markers each including a marker element and fastening means for attaching the marker element to said carrier.

13. The sight according to claim 12 wherein said carrier has an elongated slot extending in the direction parallel with said threaded shaft between the flange portions of said frame, said fastening means comprising a threaded fastener having a threaded portion to pass through said slot for clamping a marker to said carrier at a preselected position along the length thereof.

14. The sight according to claim 7 wherein said sighting means further includes means to position said stylus and lens along said rod for a coarse windage adjustment.

15. The sight according to claim 14 wherein said means to position includes a plurality of spaced-apart circumferential grooves in said rod, and means supported by said sight base for engaging in a selected one of said grooves.

16. The sight according to claim 15 wherein said grooves intersect with the longitudinal key slot in said rod.

17. The sight according to claim 14 wherein said means to position is constructed and arranged for 360° rotation of said stylus and lens on said rod.

18. A sight for aiming a bow comprising an elongated member adapted to be secured to the body of a bow above the arrow-receiving area thereof and having upper and lower generally parallel flange portions, a threaded shaft extending between said flange portions, a non-rotatable sighting assembly threadedly received on said shaft whereby rotation of the shaft will cause vertical movement of the sighting assembly, reversible electrical motor means for rotating the shaft in one direction or the other, a source of electrical energy, and a pair of switches carried on the gripping portion of said bow and connecting the energy source to the motor, one of said switches when actuated causing the motor to rotate in one direction and the other of said switches when actuated causing said motor to rotate in the opposite direction.

19. The sight of claim 18 including a transparent plate carried on said sighting element and having a plurality of different-colored concentric circles thereon through which a target is viewed, and corresponding color-coded markers vertically spaced along said elongated member, whereby when a target is encircled by a circle on the transparent plate of a particular color, one of said switches may be actuated to rotate said motor and move the sighting element to a position corresponding to the corresponding color-coded marker.

* * * * *